United States Patent [19]

Abreo, Jr.

[11] Patent Number: 4,881,850

[45] Date of Patent: Nov. 21, 1989

[54] SUBSEA GUIDEBASE

[76] Inventor: William A. Abreo, Jr., 6727 Grovewood La., Houston, Tex. 77008

[21] Appl. No.: 239,405

[22] Filed: Sep. 1, 1988

[51] Int. Cl.[4] ..... E21B 33/038

[52] U.S. Cl. ..... 405/169; 405/224; 405/188; 166/338; 166/341; 285/24; 285/84; 403/348

[58] Field of Search ..... 405/224, 195, 188, 169; 166/338, 339, 340, 341, 351, 365; 285/18, 24, 27, 81, 84, 91, 321; 403/348, 349

[56] References Cited

U.S. PATENT DOCUMENTS

| | | | |
|---|---|---|---|
| 3,321,015 | 5/1967 | Word, Jr. | 166/340 |
| 3,353,595 | 11/1967 | Nelson et al. | 166/341 |
| 3,903,965 | 9/1975 | Ahlstone | 285/18 X |
| 3,910,610 | 10/1975 | Turner et al. | 285/24 X |
| 3,918,747 | 11/1975 | Putch | 285/18 X |
| 4,139,222 | 2/1979 | Loland | 285/27 |
| 4,181,196 | 1/1980 | Darby et al. | 166/297 X |
| 4,460,047 | 7/1984 | Pokladnik | 166/355 X |
| 4,591,296 | 5/1986 | Henderson et al. | 166/339 X |
| 4,611,661 | 9/1986 | Hed et al. | 166/339 |
| 4,651,830 | 3/1987 | Crotwell | 166/338 |
| 4,653,778 | 3/1987 | Alandy | 166/339 X |
| 4,697,828 | 10/1987 | Chou | 285/18 |
| 4,773,788 | 9/1988 | Ruhl | 403/348 X |

*Primary Examiner*—Randolph A. Reese
*Assistant Examiner*—J. Russell McBee

[57] ABSTRACT

A subsea landing base including a plurality of guide posts interconnected to a housing support structure including an upper annular plate, a lower annular plate, an annular control plate supported on the upper annular plate and rotatable thereon, a connection between the control plate to a landing ring to actuate the landing ring between housing supporting position and expanded position, rotation of the control plate to one of its positions of running, released and landed and locked, and a tool for rotation of the control plate and for retrieval of the landing base.

6 Claims, 7 Drawing Sheets

SUBSEA GUIDEBASE

BACKGROUND

The present invention relates to an improved subsea guidebase which is readily retrieved and reinstalled.

U.S. Pat. No. 3,321,015 discloses a recoverable guide base in which the guide base is made in two sections which are hinged at one side and latched together at the other side with a latching element. The guide base is assembled on the conductor casing on the platform. The latching element includes a pressure responsive element which can be remotely released so that the two sections pivot apart and thus disengage from the conductor casing.

U.S. Pat. No. 3,353,595 discloses a guide base and conductor casing which are cemented in a well bore and the casing head is connected to the upper end of the conductor casing by J slots which engage pins extending from the upper end of the conductor casing.

U.S. Pat. No. 4,181,196 discloses the recovery of the guide base, conductor casing and surface casing through the use of an explosive charge which is lowered into the well below the sea floor and a tool which engages pad eyes on the upper surface of the permanent guide base for the lifting and retrieval of the equipment after the explosive has severed the casings below the floor of the water.

U.S. Pat. No. 4,460,047 discloses a lateral connector between a subsea template and a well suspension joint in which the connector includes a ring in a housing recess with the housing secured to a template and the ring is secured in the recess by shear pins. The ring resists lateral forces on the joint until the shear pins release and then acts as a lost motion connection to allow lateral motion within the limits of the movement of the ring on the annular housing recess.

U.S. Pat. No. 4,591,296 discloses a temporary guide base cable which includes sockets that pass readily through a split latch ring on the permanent guide base as it is lowered but do not release on retrieval of the permanent guide base unless overloaded so that the temporary guide base is retrieved with the permanent guide base. In the event of overloading, shear pins in the sockets release and the permanent guide base is recovered with the temporary guide base being left on the bottom for subsequent recovery.

U.S. Pat. No. 4,611,661 discloses a permanent guide base which includes a platform portion and a gimbal portion. The permanent guide base is retrievable by the separation of the platform portion from the gimbal portion which remains with the wellhead housing and a completion guide base is installed by engagement with the external wellhead housing profile.

SUMMARY

The present invention provides an improved subsea guidebase which is easily installed, retrieved and can thereafter be reinstalled. The guidebase includes the usual guideposts connected by a frame, an annular structure having an annular base supporting a split landing seat ring, an annular seat ring actuator for wedging the seat ring into its its inner housing supporting position, means for latching a housing to the guide base with the housing landing shoulder landed on the split seat ring, means connected to said annular base having three rotary positions including running, released, landed and locked positions, and means for engaging said guide base for running and retrieval.

An object of the present invention is to provide an improved subsea landing base which is both easily retrievable and reinstalled.

Another object is to provide an improved subsea landing base on which a well housing can be supported and latched into position therein and the landing base can be released from the housing and can be readily released and retrieved without disturbing the well housing after it has been cemented in the well bore.

A further object is to provide an improved subsea landing base which, once retrieved, can be reinstalled in supporting latched position around the well housing which is cemented in position in the subsea well.

BRIEF DESCRIPTION OF THE DRAWINGS

These and other objects and advantages are hereinafter set forth and explained with respect to the drawings wherein.

DESCRIPTION OF THE PREFERRED EMBODIMENT

Figure 1:
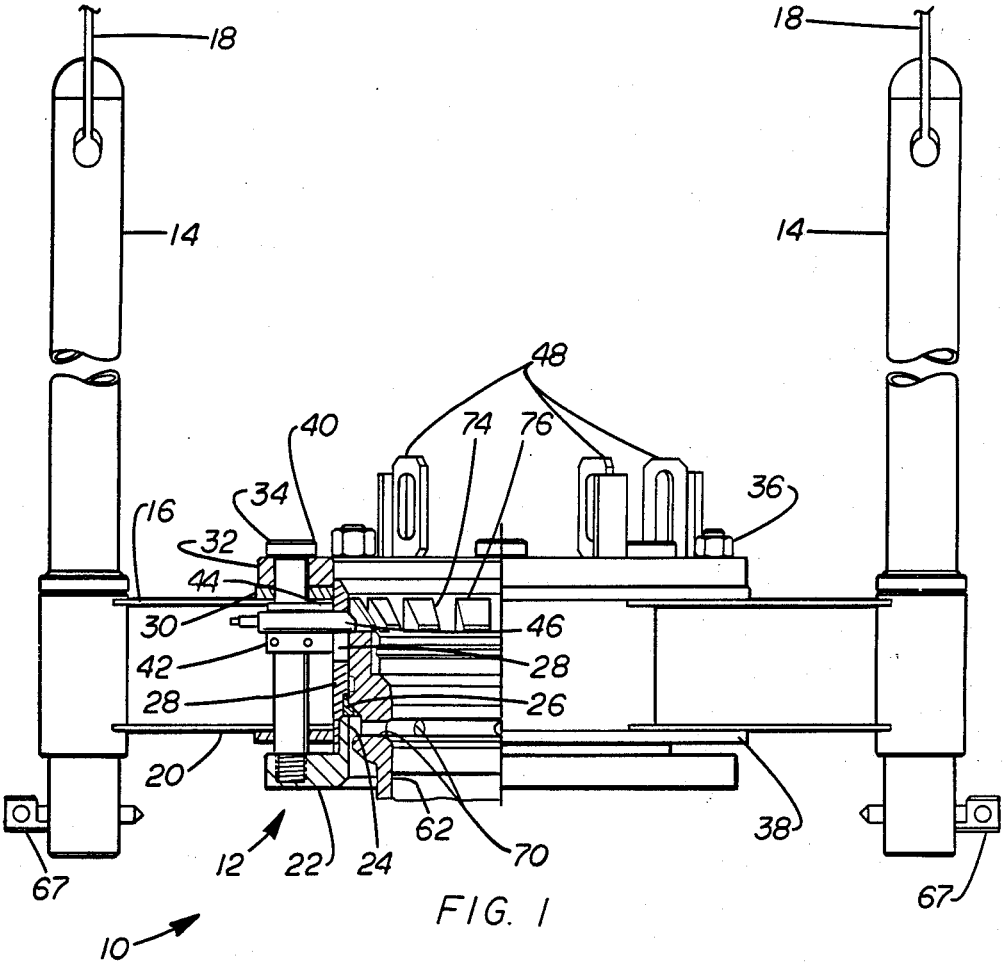
FIG. 1 is a sectional view of a subsea well having the improved landing base installed thereon and with the well housing being in supported and latched position within the landing base.
Figure 2:
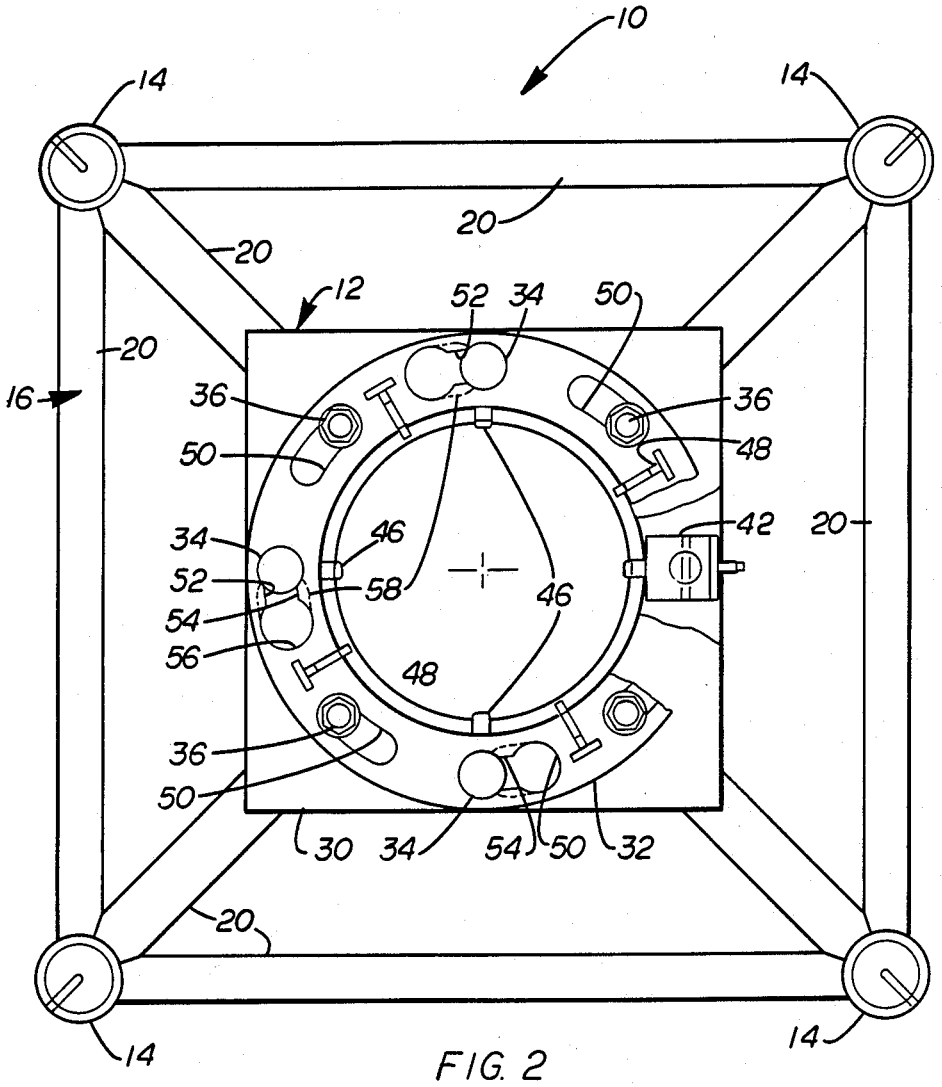
FIG. 2 is a plan view of the landing base and well housing shown in FIG. 1.

Improved subsea landing base 10, as shown, in FIG. 1 includes a central housing support structure 12, a plurality of guide posts 14 and frame 16 interconnecting support structure 12 to guide posts 14. Cables 18 extend upward from the upper end of guide posts 14 to the surface to guide tools and other components which are to be lowered downward in the water to coact with landing base 10 in a suitable manner. In the preferred form of the invention as best seen in FIG. 2, four guide posts 14 are used and frame 16 includes a plurality of structural members 20 extending between guide post 14 and support structure 12 and also between each of the adjacent guide posts 14.

Support structure 12 includes plate 22 which is positioned below frame 16 and having upwardly extending annular rim 24, split seat ring 26 positioned above rim 24, actuating ring 28 extends around split seat ring 26 and annular rim 24 with annular plate 30 secured to and extending outward from the upper end of actuating ring 28, control plate 32, carrier pins 34 and securing means 36 which connect annular plate 30 to control plate 32. Carrier pins 34 extend through control plate 32, annular plate 30, lower plate 38 and thread into plate 22. Carrier pins 34 have heads 40 on their upper ends as shown which coact with control plate 32 as hereinafter described. Support latch assemblies 42 are secured to carrier pins 34 and include housing 44 through which pins 46 are threaded for radial inward and outward motion. Pad eyes 48 are secured to the upper surface of control plate 32.

Control plate 32 is annular in shape and includes narrow arcuate slots 50 through which securing means 36, such as studs extending from plate 30 and nuts threaded on studs above plate 32, and control slots 52 through which carrier pins 34 extend. Control slots 52 each include arcuate portion 54 which is sufficiently wide to accommodate the diameter of the shank portion of carrier pins 34 and enlarged portion 56 which is sufficiently large to allow head 40 of pin 34 to pass therethrough. Additionally, slot extension 58 on the lower side of plate 32 extends partially from enlarged portion 56, being of the same diameter, to a position partially encompassing approximately half of the end of arcuate portion 54 of slot 52 so that carrier pin heads 34 may be positioned therein for running as hereinafter explained with respect to FIGS. 6 and 7.

Figure 3:
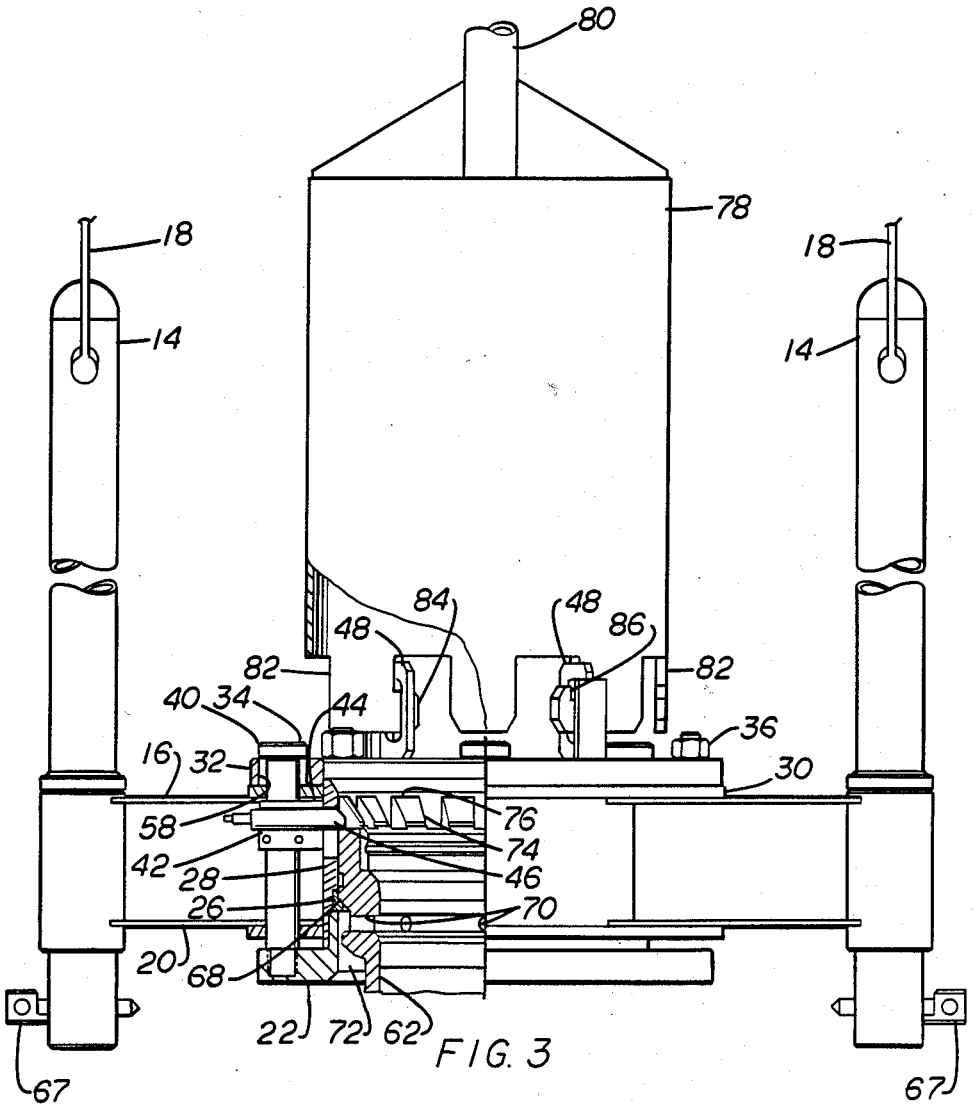
FIG. 3 is another sectional view of the landing base with the running tool in engagement therewith and having the latching means rotated by the tool to its released position.
Figure 5:
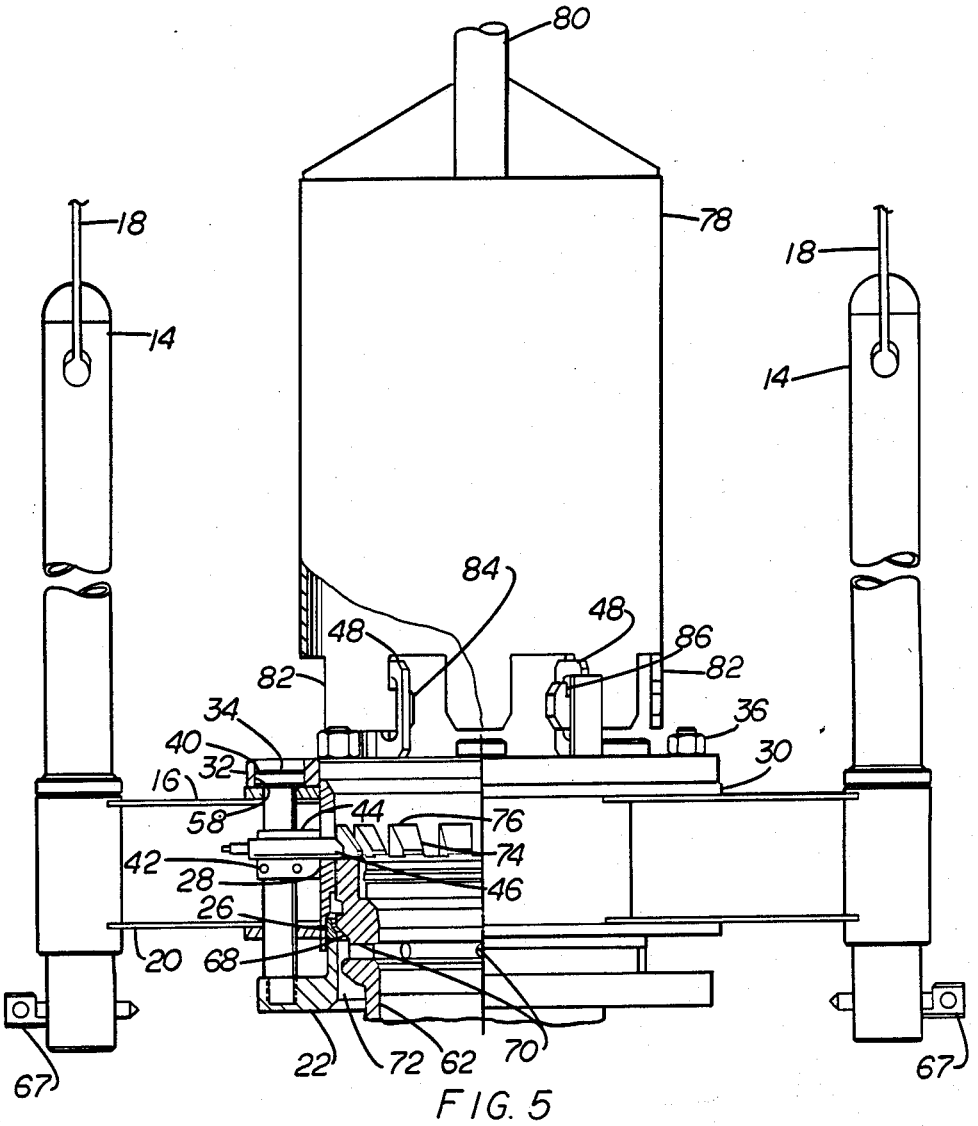
FIG. 5 is another sectional view illustrating the lifting of the landing base with respect to the well housing.
Figure 6:
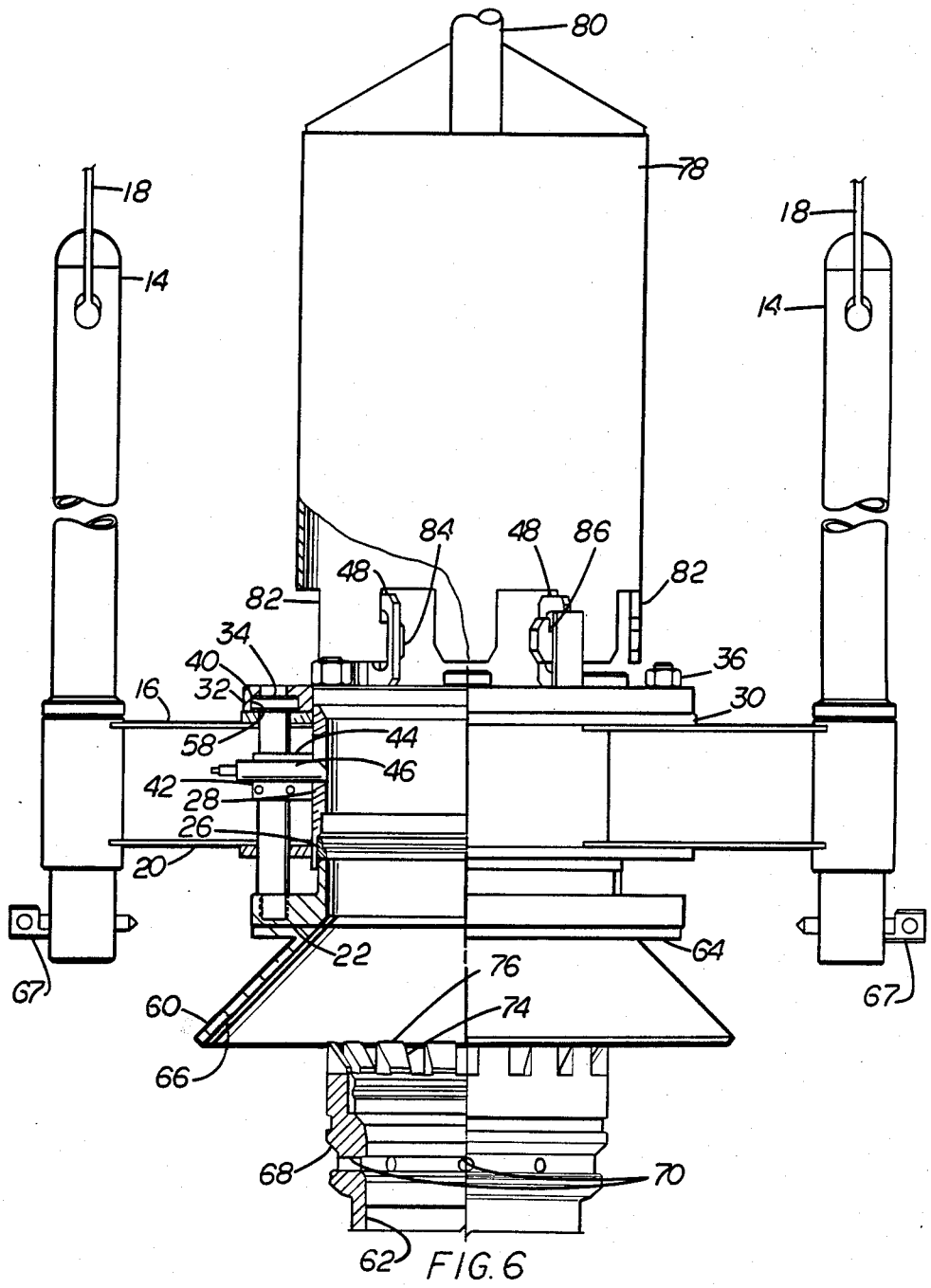
FIG. 6 is another sectional view of the landing base supported on the running tool and being lowered for reinstallation on the well housing.

While not shown in the drawings illustrating the position of the support structure 12 as originally installed, FIGS. 1, 3 and 5, but shown in FIG. 6, bell 60 is secured to the lower surface of plate 22 to assist in centering landing base 10 on well housing 62 during reinstallation. Bell 60 includes radial flange 64 which is suitably secured to plate 22 and downwardly and outwardly flaring funnel 66 which assists in the centering of landing base 10 on housing 12 during reinstallation of landing base 10. Additionally, locking pins 67 are secured through the lower portion of guide posts 14 which extend below frame 16 so that tensioning of cables 18 cannot cause the guide posts 14 to pass upwardly through frame 16 and thereby be released therefrom.

In operation, guide base 10 is normally assembled on the surface and positioned as shown in FIGS. 1 and 2 in engagement with well housing 62 for lowering with a suitable string or other suitable means into position so that well housing 62 is positioned within the well bore, supported with its external downwardly facing landing shoulder 68 supported on split seat ring 26. After landing base 10 has been landed on the bottom, fluid is circulated so that it flows through the openings 70 extending through housing 62 and also through the annulus 72 below seat ring 26, normally upwardly through annulus 72 and out through openings 70. In this manner cement is positioned around the exterior of well housing 62 below seat ring 26. It should be noted that carrier pins 34 are positioned with their heads 40 against the upper surface of control plate 32 and their shank in the most clockwise portion of control slots 50. Actuating ring 28 is in its lower position engaging split seat ring 26 and holding it radially inward in its housing supporting position. Additionally, latch pins 46 have been threaded inwardly to extend through vertical slots 29 in actuating ring 28 and are in engagement within slots 74 in the castellated upper rim 76 of housing 62. This arrangement securely connects landing base 10 to housing 62.

Figure 4:
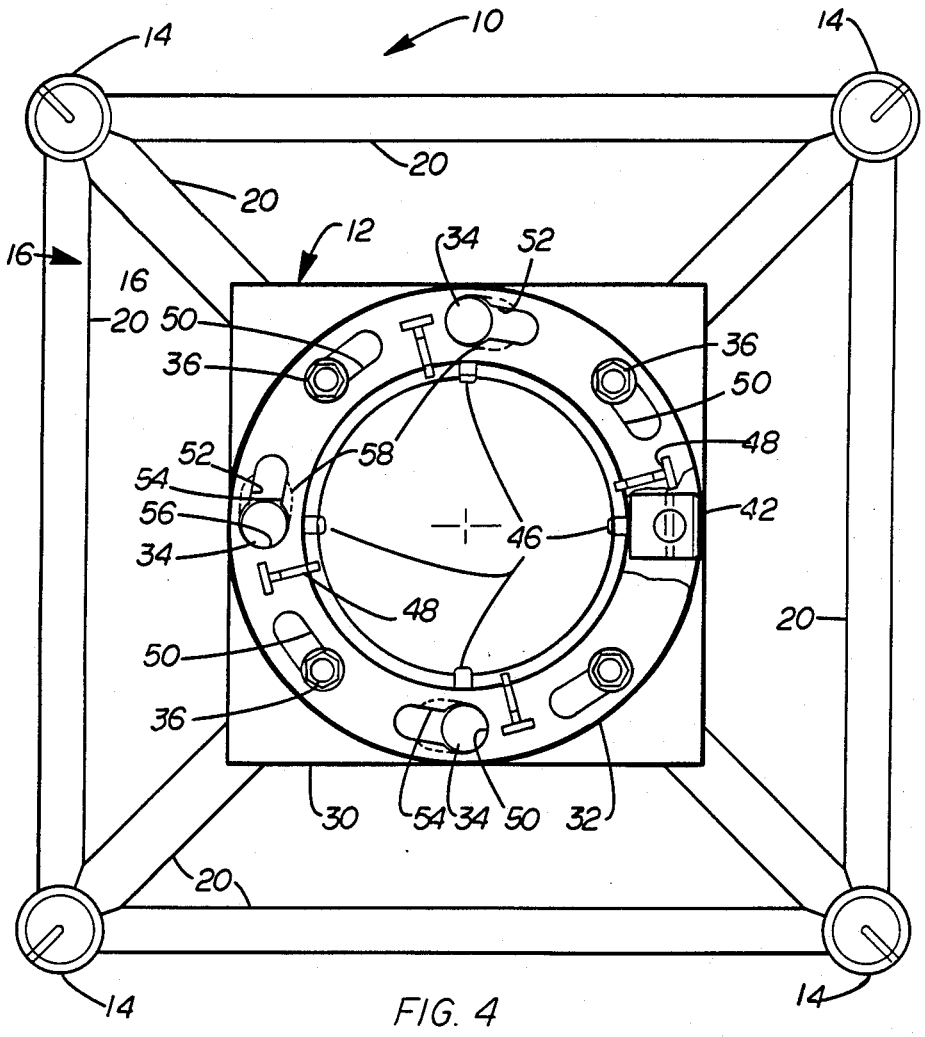
FIG. 4 is a partial plan view of the landing base shown in FIG. 3 with the running tool omitted for clarity to illustrated the position of the latching means.

Well operations are continued in a normal manner until landing base 10 is to be retrieved. At such time, running tool 78 is connected to running string 80 and lowered into position so that its depending legs 82 are spaced slightly above the upper surface of control plate 32 and the foot 84 of each of legs 82 extends in a clockwise direction and is suitably aligned for engagement within pad eyes 48. This alignment can be accomplished in the usual manner from guide cables 18. When tool 78 is properly positioned with respect to pad eyes 48, string 80 is rotated to the right to place each foot 84 in the opening of one of pad eyes 48. String 80 is then lifted slightly to cause pad eyes 48 to be engaged by shoulder 86 which faces in a counter clockwise direction so that any force tending to rotate tool 78 in either direction is imparted to pad eyes 48. As can be seen from a comparison of the position of control plate 32 in FIGS. 2 and 4, control plate 32 has been rotated clockwise to move the shafts of carrier pins 34 from their position in the end of arcuate portion 54 of slots 52 to the enlarged portions 56 of slots 52 as shown in FIGS. 3 and 4.

Subsequent lifting on running string 80 will raise control plate 32 and plate 30 which is secured to plate 32 by securing means 36. Actuating ring 28 is also raised so that its camming portion, which normally engages seat ring 26 to retain it in supporting position to housing 62, is positioned above split seat ring 26 which allows seat ring 26 to expand radially outward out of engagement with landing shoulder 68 on housing 62 and into engagement with the interior of the lower rim of actuating ring 28 for support during retrieval. During this initial lifting, carrier pins 34 and plate 22 are not raised since heads 40 of carrier pins 34 enter enlarged portions 56 of slots 52 and are not raised until heads 40 are engaged by the upper surface of plate 30. This allows sufficient movement for the release of seat ring 26. Vertical slots 29 in actuating ring 28 allow upward movement of actuating ring 28 while lock pins 46 remain in engagement with their slots 74 in upper rim 76 of housing 62. This position is shown in FIG. 5 and further lifting of running string 80 causes landing base 10 to be lifted clear of housing 62 and retrieved to the surface.

Figure 7:
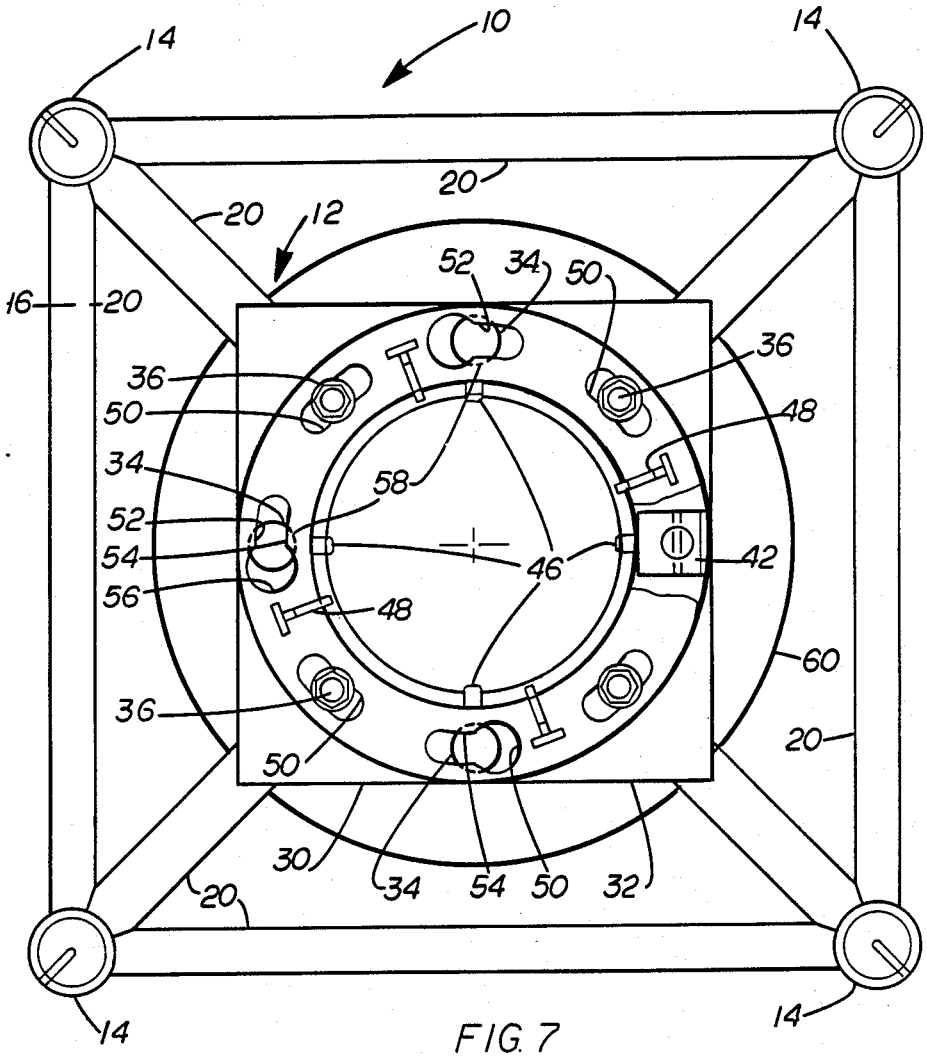
FIG. 7 is a partial plan view of the landing base shown in FIG. 6 to illustrated the position of the control plate during running.

Following replacement of parts, repair or other operations at the surface with respect to landing base 10, it is again secured to running tool 78 in the position shown in FIGS. 6 and 7 and can then be lowered into position over housing 62. The relative position used in preparing landing base 10 for reinstallation is similar to its retrieval position except that heads 40 of carrier pins 34 are positioned in engagement with the upper surface of plate 30 and in slot extension 58 as shown. This positions actuating ring 28 in supporting position around split seat ring 26 without camming split seat ring 26 inwardly. In this position when landing base 10 is centralized on housing 62 it can be lowered downwardly thereover until split seat ring 26 is immediately under but spaced outward from landing shoulder 68. Control plate 32 is then rotated clockwise to position heads 40 in enlarged portions 56 of slots 52 and then control plate 32 is lowered over carrier pins 34 to move actuating ring 28 downward within split seat ring 26 to cam it inwardly into supporting engagement with landing shoulder 68. Thereafter, control plate 32 is rotated in a counter clockwise direction to move the shanks of carrier pins 34 into the ends of the arcuate portions 54 of slots 52 to secure the position of all the components. Further, latch pins 46 are shown in their retracted position and by use of a diver or a suitable ROV they may be extended into engagement with slots 74 in upper rim 76 of housing 62. However, it is preferred that latch pins 46 be extended at the surface and on landing around housing 62, landing base 10 is rotated to ensure the entry of lock pins 46 within slots 74 before the operation of setting split seat ring 26 in position.

With the completion of these operations, the position of landing base 10 and its components with respect to housing 62 will be as shown in FIGS. 1 and 2. With this structure it is a simple matter to retrieve the landing base for repair or for other reasons and reinstall it in position on the well housing 62.

I claim:

1. A subsea landing base comprising:
a central annular housing support structure,
a plurality of guide posts, and
a frame connecting said guide posts to said housing support structure,
said support structure having:
a split seat ring,
means for actuating said split seat ring into a housing supporting position,
means for retaining said split seat ring in its housing supporting position, and
means for releasing said retaining means to allow retraction of said split seat ring,
wherein said retaining and releasing means includes:
an upper annular plate supported by said frame,
an annular control plate positioned above said upper plate,
an annular lower plate spaced below said upper annular plate,
a plurality of carrier pins secured to said lower plate and extending upwardly through said upper plate and said control plate and having heads engaging the upper surface of said control plate when said split seat ring is in its housing supporting position,
means connecting said upper plate to said control plate to limit vertical movement of said upper plate and said control plate with respect to each other, and
a plurality of openings in said control plate through which said carrier pins extend allowing said control plate to be rotated relative to said upper plate and to be raised without raising said carrier pins, which raising withdraws the actuating means from its position retaining the split seat ring in its housing supporting position.

2. A subsea landing base according to claim 1 wherein said actuating means includes
means for supporting said split seat ring, and
an actuating ring which is positioned around the exterior of said split seat ring and having an internal camming surface,
said actuating ring being movable axially in one direction with respect to said split seat ring and said supporting means to cam said split seat ring inwardly into said housing supporting position and in the opposite direction to release said split seat ring from its housing supporting position.

3. A subsea landing base according to claim 1 including
lock pins supported by said support structure and movable radially to engage the upper end of said housing support structure.

4. A subsea landing base according to claim 1 wherein said plurality of openings in said control plate include
a plurality of arcuate openings having an enlarged portion at one end of the openings allowing vertical movement of the heads of the carrier pins to pass therethrough.

5. A subsea landing base according to claim 4 including
an enlarged recess in the under side of said control plate at an intermediate portion of said arcuate openings.

6. A subsea landing base according to claim 4 wherein said actuating means includes
a ring secured to said upper plate and movable therewith relative to said lower plate and said split seat ring,
said ring having an internal camming surface for engaging the exterior of said split seat ring to support it in its radial expanded position and to wedge it radially inward to its housing supporting position when said ring is in its upper and lower positions, respectively.

* * * * *